US009527122B2

(12) United States Patent
Bammer et al.

(10) Patent No.: US 9,527,122 B2
(45) Date of Patent: Dec. 27, 2016

(54) DEVICE AND METHOD FOR THE LASER-SUPPORTED BENDING OF WORKPIECES

(75) Inventors: Ferdinand Bammer, Vienna (AT); Dieter Schuoecker, Vienna (AT); Thomas Schumi, Vienna (AT); Gerhard Sperrer, Oberschlierbach (AT)

(73) Assignee: TRUMPF Maschinen Austria GmbH & Co. KG., Pasching (AT)

( * ) Notice: Subject to any disclaimer, the term of this patent is extended or adjusted under 35 U.S.C. 154(b) by 1079 days.

(21) Appl. No.: 13/381,192

(22) PCT Filed: Jun. 28, 2010

(86) PCT No.: PCT/AT2010/000236

§ 371 (c)(1),
(2), (4) Date: Mar. 15, 2012

(87) PCT Pub. No.: WO2011/000012

PCT Pub. Date: Jan. 6, 2011

(65) Prior Publication Data

US 2012/0168992 A1 Jul. 5, 2012

(30) Foreign Application Priority Data

Jun. 29, 2009 (AT) ..... A 1012/2009

(51) Int. Cl.
*B23K 26/26* (2014.01)
*B21D 5/02* (2006.01)
*B21D 37/16* (2006.01)

(52) U.S. Cl.
CPC ..... *B21D 5/0209* (2013.01); *B21D 37/16* (2013.01)

(58) Field of Classification Search
CPC ..... B21D 37/16; B21D 5/0209; B21D 5/01; B21D 5/00; B21D 37/00; B23K 26/02; B23K 26/26; B23K 26/0643
(Continued)

(56) References Cited

U.S. PATENT DOCUMENTS 4,550,586 A 11/1985 Aubert et al.
5,359,872 A 11/1994 Nashiki
(Continued)

FOREIGN PATENT DOCUMENTS

AT 411 023 9/2003
DE 195 14 285 6/1996
(Continued)

OTHER PUBLICATIONS

Japanese to English translation of JP 2001030011 A.*
(Continued)

*Primary Examiner* — Tu B Hoang
*Assistant Examiner* — Michael Hoang
(74) *Attorney, Agent, or Firm* — Collard & Roe, P.C.

(57) ABSTRACT

A method for guiding and distributing high-energy radiation, in particular laser radiation, in the tool base body of a bending die, in particular a V-shaped die, includes a bending recess in the tool base body and a beam exit opening arranged therein for locally heating a workpiece bearing against a contact surface of the bending die by introducing high-energy radiation from a radiation source arranged outside the tool base body into the tool base body through a beam entry opening and high-energy radiation is discharged to the bending recess through the beam exit opening. At least one concentrated high-energy radiation beam is introduced into the tool base body through at least one beam entry opening and is at least partially deflected by at least one beam affecting arrangement in the tool base body, expanded
(Continued)

and guided through the radiation exit opening onto the workpiece.

34 Claims, 5 Drawing Sheets

(58) Field of Classification Search
USPC ..... 219/383, 121.6; 264/482; 72/342, 342.5, 72/342.6, 342.94
See application file for complete search history.

(56) References Cited

U.S. PATENT DOCUMENTS

| | | | | |
|---|---|---|---|---|
| 6,251,328 | B1 | 6/2001 | Beyer et al. | |
| 6,415,639 | B1 * | 7/2002 | Kilian et al. | 72/342.1 |
| 7,514,305 | B1 * | 4/2009 | Hawryluk | H01L 21/67115 438/166 |
| 2004/0074881 | A1 * | 4/2004 | Oishi | 219/121.63 |
| 2006/0179913 | A1 * | 8/2006 | Strasser | 72/420 |

FOREIGN PATENT DOCUMENTS

| | | | | | |
|---|---|---|---|---|---|
| EP | 0 108 718 | | | 5/1984 | |
| EP | 0 993 345 | | | 4/2000 | |
| EP | 1 961 502 | | | 8/2008 | |
| GB | 2166986 | A | * | 5/1986 | B21D 7/02 |
| JP | 1-233019 | | | 9/1989 | |
| JP | 2-280930 | | | 11/1990 | |
| JP | 5-096329 | | | 4/1993 | |
| JP | 05096329 | A | * | 4/1993 | B21D 5/01 |
| JP | 2001030011 | A | * | 2/2001 | |
| JP | 2003-311331 | | | 11/2003 | |
| JP | 2004-034074 | | | 2/2004 | |

OTHER PUBLICATIONS

International Search Report of PCT/AT2010/000236, Oct. 12, 2010.
English Translation of International Preliminary Report on Patentability and Written Opinion of the International Searching Authority in PCT/AT2010/000236, Jan. 17, 2012.

* cited by examiner

DEVICE AND METHOD FOR THE LASER-SUPPORTED BENDING OF WORKPIECES

CROSS REFERENCE TO RELATED APPLICATIONS

This application is the National Stage of PCT/AT2010/000236 filed on Jun. 28, 2010, which claims priority under 35 U.S.C. §119 of Austrian Application No. A 1012/2009 filed on Jun. 29, 2009. The international application under PCT article 21(2) was not published in English.

BACKGROUND OF THE INVENTION

1. Field of the Invention

The invention relates to a method as described herein and also relates to a bending die as described herein.

2. Description of the Related Art

For a long time, the bending of workpieces has been a frequently applied and reliable method for processing workpieces by reshaping. The scope of application of bending processes is frequently limited by material properties, especially by the mechanic-technological properties. The problem concerning brittle materials like magnesium, titanium, spring steels, high-strength aluminum-alloys, high-strength steels or other materials known to be brittle is that in case of a deforming by bending, these materials do not provide sufficient plastic formability and thus other undesired deformations appear. A parameter that can indicate the respective behavior of materials is the so-called ultimate strain that means the value of the plastic deformation that a workpiece to be deformed can bear until it breaks. An alternative parameter for this behavior is also the so-called yield strength to tensile strength ratio that considers the tension required in a workpiece at the beginning of a noticeable plastic deformation in relation to the tension within the workpiece in case of breaking load.

In order to make such materials having a low ultimate strain or a high elasticity ration accessible to the application of a deformation methods, especially to bending, methods putting the workpiece into a condition providing more favorable mechanic characteristics and enabling it to be deformed by means of a bending method have been applied for a while. A known method is heating the workpiece to be bent at least in the region of the deformation zone, with the result that in this heated area the tension necessary for initiating of plastic deformation can be reduced.

As an example of such a method, the EP 0 993 345 A1 discloses a method for bending a workpiece by application of mechanic force under selective heating of the workpiece along a bending line by means of laser radiation, where one laser beam or several laser beams are formed to be an elongate radiation field and where a heating zone along the bending line of the workpiece is created by the radiation field. In this case, the device for forming the linear radiation field comprises cylindrical lenses and/or cylindrical mirrors, which are used to guide a radiation field through the opening in the bending die onto the workpiece. In the exemplary embodiment according to FIG. 4 of the EP-A1, a laser beam is split into two radiation fields by means of a beam forming optic, which consists of a prism mirror, two cylindrical lenses and two cylindrical passive deflectors. The two radiation fields are guided through the bending die onto the workpiece and produce respective linear heating zones. The laser beam deformed this way is thus guided onto the workpiece through a slot-like opening in the bottom side of the die.

This solution for the guiding of high-energy radiation in a bending die known from the EP 0 993 345 A1 is not ideally suited for the practical application with common bending machines, because the bending die provides a limited mechanical strength due to its two-piece embodiment and the press beam receiving the bending die would have to provide recesses for the beam distribution arrangement.

SUMMARY OF THE INVENTION

The object of the invention is to provide a bending die that is applicable to a bending method according to its genre, which is better applicable for practical application.

The object of the invention is achieved by a method according as described herein and is achieved by a bending die with characteristics described herein.

Due to the fact that at least one concentrated high-energy radiation beam is guided into the tool base body through at least one beam entry opening and said radiation beam is at least partially deflected, expanded in the tool base body by a beam affecting arrangement and is guided onto the workpiece through the beam exit opening, such a bending die can, on the one hand, be used at every conventional bending press or trimming press and, on the other hand, every conventional radiation source, applicable for the production of a concentrated radiation beam, can be used as radiation source for the application of the method. This is a large economic advantage, because in many production plants both a conventional bending press and an applicable radiation source, especially a laser device, are available and their fields of application can be expanded due to the application of the method according to the invention. Thus, only by the application of the method according to the invention or the bending die according to the invention, an expansion of the available production methods as well as an improved capacity utilization of the existing mechanical infrastructure is possible. The deflection, expansion and discharge of the radiation during the heating phase is in this case effected particularly temporally and locally stationary without application of mechanical moved, rotating or swinging mirrors or apertures.

The outer dimensions of such a bending die can in this case particularly correspond to these of conventional bending dies, with the result that in the application no restrictions with respect to the geometry are necessary compared to conventional bending dies.

The beam affecting arrangement comprises means to be able to deflect and/or form and/or divide concentrated beams, with the result that from a concentrated beam essentially expanding in one straight line a radiation most evenly spread in one plane, particularly a planar fanned beam, is produced. The tool base body allows the same bending methods like a conventional bending die that is applicable for air bending. At the same time, the tool base body forms a housing for the high-energy radiation, with the result that also measures concerning industrial safety are simplified.

A further embodiment of the method is that at least the one concentrated radiation beam is divided into at least two radiation beam portions by means of the beam affecting arrangement in the tool base body, and at least one of the radiation beam portions is deflected, expanded and discharged onto the workpiece through the beam exit opening. Thus, after expansion, one beam radiation portion is available for the local heating of the workpiece and a second beam radiation portion can be guided to a place distant therefrom, especially to another heating zone at the workpiece than the zone of the workpiece being irradiated by the first radiation beam portion.

The method can furthermore be supplemented in a way that at least one concentrated beam radiation portion is decoupled from the concentrated radiation beam or the concentrated radiation beam portions by means of the beam affecting arrangement and guided to an adjacent bending die through a beam transfer opening in the tool base body. Thus, the method can be used with bending dies directly aligned having only one radiation source and the application is not limited to one single bending die, with the result that also large bending dies are made accessible to the method according to the invention. For this purpose, a beam entry opening is provided in the adjacent bending die with a thereto connected beam affecting arrangement, too, which can be used to guide at least the one concentrated radiation beam guided into the further tool base body onto the workpiece along the bending recess.

The method can furthermore be embodied in the form that in case of two or more bending dies stringed together a certain part, preferably at all bending dies the same proportion or an adjustable changeable proportion adjusted to the workpiece, of the radiation performance of the radiation source is guided to the respective bending recess by means of the beam affecting arrangement, with the result that an at least approximately even power density is effected along the bending line or the power density is adjustable to the respective power requirement existing. Thereby it is ensured that each part of the deformation zone of the workpiece gets the necessary heating and that the desired bending result is obtained along the entire die length in constant quality. Due to this embodiment, at least one guided in concentrated line-shaped radiation beam is split up into at least two or more planar fanned beams that with an even distribution along the deformation zone effect an even heating of the workpiece in this region.

As a means for the distribution of the beam into several radiation beam portions, for example beam splitter plates, combinations of half-wave plates followed by polarizing filters, beam splitter cubes, polarization beam splitter or similar beam splitting optical elements are a possibility. The spreading or the expansion of the split radiation beam portions are for example effected by cylindrical lenses or convex mirrors.

An advantageous exemplary embodiment of the method is that at least two concentrated high-energy radiation beams are guided into the tool base body and one radiation beam portion is decoupled from each radiation beam portion by means of the beam affecting arrangement and transferred to an adjacent bending die. In case of such a bending die arrangement, there are thus two or several radiation beams passing through the bending dies one after another and in each bending die, one proportion of each radiation beam is deflected onto the workpiece and another proportion is transferred to the next bending die. This insertion of at least two concentrated radiation beams into the die arrangement also allows the usage of a radiation source emitting a non-polarized radiation that means for example the usage of a solid-state laser, the radiation of which is, already before the die arrangement, split into two approximately equal but different polarized radiation beams by a polarization beam splitter. Within each of the die arrangements, radiation beam portions of defined radiation intensities can be decoupled from said radiation beams and deflected onto the workpiece by using further polarization beam splitters. Thereby, also any number of congeneric bending dies can be stringed together to be a die arrangement, with the total length only being limited by the total power of the concentrated radiation beams inserted, because the power of radiation beam portions transferred gradually or progressively decrease in their course due to the parts decoupled and deflected onto the workpiece. By the insertion of two concentrated radiation beams into one bending die, particularly two uncouplings, being arranged offset one after another in the distribution direction of the radiation beams, can be effected into the direction of the workpiece, with the result that elongate planar fanned beams hit the bottom side of the workpiece in the deformation zone one after another or stringed together overlapping each other.

The beam affecting arrangement mounted in the interior of the bending die can comprise two or more beam splitter elements being arranged one after another within a beam path and having decreasing transmittances and increasing reflectances The first beam splitter element can for example have a transmittance of 50% and a second beam splitter element can have a transmittance of 0%, with the result that at the first beam splitter element 50% of the radiation power is guided onto the workpiece and at the second beam splitter element also 50% of the radiation power is guided onto the workpiece. In case of an arrangement with three beam splitter elements, the first beam splitter element has a transmittance of 66%, the second beam splitter element has a transmittance of 50% and the third beam splitter element has a transmittance of 0%, with the result that 33% of the original radiation power are decoupled towards the workpiece at every beam splitter element. The last beam splitter of such a beam affecting arrangement is thus embodied to be a 100% reflecting beam splitter or a mirror.

For the decoupling of concentrated radiation beam portions from the inserted concentrated radiation beam within the bending die, polarization beam splitter can advantageously be used, which allow to variably mutually affect the proportion of radiation beam portions having been let pass and radiation beam portions having been deflected when using polarizing filter elements or half-wave plates.

As a further means for the decoupling of beam portions, variable coated beam splitter plates with decreasing transmittances or so-called FTIR elements are possible that comprise two 45° prisms being pressed to one another by a piezo adjusting element and that have different transmittances depending on the size of an adjustable air gap between the two prisms, so as to adjust the transmission with the help of the piezo tension that will be described below.

Because a local heated workpiece can be easily deformed due to thermal warping, it is advantageous if the workpiece is clamped by a bending punch cooperating with the bending die during the application of high-energy radiation. Thus it is ensured that the workpiece stays in the position planned during the heating by high-energy radiation and the bending is carried out exactly at the bending line planned.

For the application of the method, advantageously a solid-state laser, for example a Nd:YAG laser device or a gas laser, for example a CO2 laser device, being characterized by their high beam power and already exist in many production plants, can be used as radiation source.

In order to be able to control the local heating of the workpiece to be bent better it is advantageous if the power emitted by the radiation source and/or the exposure duration of the radiation at the material and/or the geometric dimensions of the workpiece to be bent are adjustable by means of a control device. In this case, the control device used therefor can be realized by the control device of the bending press as well as the control device of the radiation source or as an own control device.

At least two beam paths can be arranged spaced apart from and parallel to one another in the bending die, and each beam path can be made of own channels or bores in the tool base body or they can also extend in a common beam channel or a corresponding hollow space in the interior of the bending die. Thus, the several beam paths for several radiation beams can follow a common beam entry opening or several own beam entry openings. Due to the fact that the beam paths are spaced apart from one another, the each of single radiation beams can be deflected to different positions of the workpiece by an own beam affecting arrangement, particularly beam splitter elements and/or beam deflectors, arranged in the respective beam path, with the result that an even distribution of the radiation power along the deformation zone of the workpiece can be effected. Preferably a prism, a mirror or a beam splitter element can be used as a beam deflector in this case.

For the widening of the beam, the beam affecting arrangement comprises preferably at least one cylindrical lens that causes that a line-shaped beam or a line-like radiation beam is expanded to be a planar fanned beam extending in a plane, preferably in the bending plane, with the result that the beam power of the single concentrated radiation beam or radiation beam portion is spread over a elongate area. The cylindrical lens can also be used to fan a beam already fanned further in the same beam plane, if the cylindrical lens has an axis of curvature perpendicular to the beam plane and thus the plane of the fanned planar fanned beam is not changed.

In a further advantageous embodiment, the beam affecting arrangement comprises at least one beam splitter element for producing at least two radiation beam portions, with the result that one proportion of the concentrated inserted radiation beam can be used for the local heating of the workpiece and the second radiation beam portion can either be used for heating the workpiece within the same bending die, too or is available to be transferred to a next bending die.

The beam splitter element in the bending die can comprise a half-wave plate that is rotatable around the optical main axis and has a motorized drive, for example in form of a stepper motor. Using this half-wave plate, the polarization plane of a concentrated, polarized radiation beam can be rotated and thus the level of decoupling can be varied. Such a variable beam splitter element for polarized radiation beams thus comprises a rotatable half-wave late and a polarization beam splitter element.

In the case of using beam splitter elements basing upon polarization, particularly polarizing beam splitter cubes, alternatively to the a half-wave plate rotated by a stepper motor, also the usage of a so-called Pockels cell, a photoelastic modulator or an optical element being mechanically energized may be suitable for checking the polarization.

A Pockels cell bases upon an electro-optical effect, with a refractive index of the medium, for example a crystal built up from lithium-niobate, being changed under the influence of a variable electric field and thus enabling a variable polarization rotation. However, for achieving this effect, relatively high voltages are necessary, which are nevertheless technically well controllable.

A photoelastic modulator bases upon the photoelastic effect that is used in photoelasticity is used to show stress conditions in transparent items. Due to mechanic stresses, the polarization effect of such a modulator can be changed. The mechanical stresses can in this case be accomplished by the optical effective element itself being designed as a piezo actuator, which causes a photoelastic effect in itself when appropriate voltage is applied. By appropriate modulation of this voltage, a high-frequency polarization modulation can be produced and thus a variable level of decoupling can be achieved.

Alternatively, also an isotropic transparent optical element can be used, which is mechanically energized by screws or piezo actuators so as to effect an artificial birefringence with an effect similar to that of a half-wave plate and a corresponding split of a polarized radiation beam due to the photoelastic effect.

All electrically controllable variants (FTIR with piezo actuator, stepper motor for half-wave plate, Pockels cell, photoelastic modulator, isotropic material under mechanical stress by piezo actuator) are well applicable for an automated control by means of a feedback circuit, which measures the intensity of a decoupled radiation beam portion and from this signal generates a control signal for the controllable beam splitter element or the polarization controlling unit connected ahead to automatically achieve an even distribution of performance between all radiation beam portions.

As a reference signal for each feedback circuit can probably serve the performance measurement of the last radiation beam portion, which is completely deflected by a reflecting beam splitter element or mirror, so that all feedback circuits try to obtain the same performance for their beam portion as in the last radiation beam portion. This of course assumes a sensible choice of regulation parameters or amplification to avoid a chaotic oscillating of said control.

Beam splitting elements that are also suitable for non-polarized radiation beams can for example be formed by using an FTIR element (frustrated total internal reflection) with a piezo actuator for adjusting the width of the slot.

Another possibility is to use as a beam splitter element a so-called Powell lens, which can also be used to decouple a radiation beam portion from a concentrated radiation beam. A Powell lens has a aspheric profile in one coordinate direction, and is flat in the coordinate orthogonal thereto so that a nearly homogenized line-shaped beam field can be formed of a radiation beam portion and used as a planar fanned beam.

By means of these optical elements the proportion of the radiation let pass and deflected decoupled radiation can be variably changed with the result that the distribution of the beam power can be adjusted to workpiece or to the combination of bending dies used in a die arrangement. By a beam splitter element of this kind, the intensities of the produced radiation beams can be mutually affected.

By a beam splitter element that, viewed in the direction of the beam distribution, comprises a half-wave plate and a following polarization splitter element, an advantageous arrangement of beam splitting stages can be formed in the following way: an entering concentrated radiation beam is brought into the non-polarized possible state by means of a depolarizer and subsequently split up into two equal linear polarized beam portions by means of a first polarization filter, if applicable already outside of the bending die. By the half-wave plate the polarization plane of the beam portions can be rotated and together with the subsequent polarization splitter element letting pass unhindered the linear polarized beams in a defined polarization plane and reflects beams perpendicular thereto, the polarization plane of the radiation beam portion can be adjusted by rotating the half-wave plate, with the result that also the proportion of the beam power reflected of let pass by the polarization splitter element can be influenced actively. Thus, the respective decoupled beam intensity can be adjusted to number of the required decouplings by the corresponding adjustment of the beam splitter elements.

The bending recess of a bending die according to the invention is formed of an elongate, in particular a V-shaped groove, with the result that the bending die can be used for the universally applicable air bending. The beam path of the concentrated and not deflected radiation beam or radiation beam portion in this case extends in the interior of the tool base body, approximately parallel to the groove. Due to this orientation of the beam path within the tool base body, bending dies of this kind can be stringed together in a simple manner to be a die arrangement that is adjusted to the dimensions of workpieces.

The beam affecting arrangement of the bending die can furthermore comprise at least one collimation lens in the beam path of at least one radiation beam or the radiation beam portions, with the result the inevitable occurring beam widening in a beam path can be compensated. Thus, the radiation beam also extends concentrated and with high energy density over longer distances.

The beam affecting arrangement arranged in the beam path of a radiation beam or a radiation beam portion preferably comprises a half-wave plate, at least one cylindrical lens as well as one prism each for forming the beam, with the half-wave plate being used for rotating the polarization plane of a decoupled or deflected radiation beam or radiation beam portion and the prism being used for deflecting and/or distributing of the planar fanned beam. By means of prisms, the fanned beam portions are deflected essentially within a common distribution plane, preferably within the bending plane to the bending line or the deformation zone of the workpiece. By this combination of optical elements the advantageous deformation of a concentrated radiation beam to at least one planar fanned beam suitable for the heating of a line-shaped deformation zone and a possible required deflection of the planar fanned beam can be realized using simple means.

The passing through at a prism is effected at least approximately to the Brewster angle, at which only a little loss of reflection occurs.

The beam affecting arrangement can also be formed in such a way as to comprise a beam splitter element, splitting up concentrated radiation beams into two or more radiation beam portions, and a beam forming element which is arranged between the beam splitter element and the beam exit opening and which spreads at least a radiation beam portion radiated by the beam splitter element into the region of the deformation zone of the workpiece. Lenses, mirrors, prisms in all suitable embodiments can be used as beam forming elements here.

To simplify the arrangement of a die arrangement made up of several bending dies it is advantageous if the beam path within the tool base body runs from the beam entry opening to the beam affecting arrangement and in the following from the latter to a beam transfer opening that can be coupled to a beam entry opening of an adjacent bending die by correspondence of the cooperating dimensions and positions. For this purpose, beam entry opening and beam transfer opening of such a bending die are preferably arranged along a straight line and the beam affecting arrangement is positioned on the connecting line in between.

An advantageous constructional embodiment of the bending die is achieved if the tool base body comprises at least two flat tool sections that are parallel to and spaced apart from one another and a beam affecting arrangement is positioned between. The beam affecting arrangement is thus extensively included within the interior of the tool base body and the beams run in the beam paths defined or limited by the tool base body, with the result that an uncontrolled emission of radiation probably endangering an operator is avoided to a large extend. Due to the flat tool sections the tool base body has an approximately U-shaped cross section, with the beam affecting arrangement being arranged in the interior of the U and the workpiece to be bent rests on the legs of the U.

The mechanical strength of the bending die according to the invention can substantially be increased if at least one spacer element and at least one clamping element clamping the tool base body against the spacer element are arranged between the beam affecting arrangements and the beam exit opening. An expansion of the bending die by the bending punch can thus be counteracted, in fact, the better, the closer the spacer element or the spacer elements are positioned at the beam exit opening or the bending recess. In the event of a failure, these spacer elements furthermore cause an additional safety from a penetration of the bending punch into the interior of the bending die, what could have the result that the latter and in particular the beam affecting arrangement could be destroyed.

In order to be able to employ a bending die according to the invention at most possible bending presses or press brakes, it is advantageous if the tool base body at its end section facing away from bending recess features a connection profile that can be accommodated in a standard tool holder. In this case, said connection profile can have additional recesses or grooves, which can probably cooperate with locking elements of the tool holder.

Due to the reason that in case of heating a workpiece heat always drains into cooler areas that are not exposed to the radiation and thus into the bending die, it is advantageous if the contact surface of the bending die is made of a material with a lower coefficient of heat-conductivity than the tool base body. For this purpose, the contact surface can for example be formed of strip-shaped PEEK-plastics elements or other heat insulating materials that are fixed to the top face of the tool base body. The lay-on points, effective after the beginning of the deformation process and cooperating with the workpiece can be positioned at the tool base body itself for stability reasons.

In order to further reduce the heat flow, at least sections of the tool base body can be formed of a metal with a low coefficient of heat conductivity. Because the heat expansion of the tool base body arising from the increase of temperature of the bending die should be furthermore kept as small as possible, it is furthermore advantageously possible to produce the tool base body of a metal with a low coefficient of thermal expansion.

Because not every workpiece covers the entire bending recess, because its bending length is shorter than the length of the bending die and an emission of high-energy radiation next to the workpiece should be avoided due to job security reasons, in case of an advantageous embodiment of the bending die at least one adjustable shielding element for covering sections not being covered by the workpiece is provided between the beam exit opening and the contact surface. Said shielding element can be embodied as a slider adjustable along the bending recess and, depending on the bending length of the workpiece, the part of the bending recess that is not covered by the workpiece is thus covered by the shielding element.

A bending die according to the invention can be such embodied that the tool base body comprises a die adaptor creating the contact surface and the bending recess, with the die adaptor being exchangeable arranged at the remaining part of the tool base body which contains the beam affecting arrangement. By exchanging the die adaptor the tool base body can thus be adjusted to different bending tasks. It is particularly possible to change the die width, which causes the range of application of such a bending die to be substantially larger. Furthermore, such a bending die being relatively expensive due to the inserted beam affecting arrangement, can be applied more frequently and thus more cost-effectively.

A constructional advantageous longitudinal dimension of a bending die according to the invention is preferably 100 mm, with the result that in the interior of the tool base body sufficient space for the mounting of common and easily obtainable optical components is given and that half-wave plates, beam splitter prisms, polarization beam splitter collimation lenses, cylindrical lenses etc. are obtainable at low prices. A bending die length of 100 mm allows at a total height of the bending die of for example 120 mm the insertion of two concentrated radiation beams from each of which one radiation beam portion can be decoupled spacially offset one behind another.

In order to deform also workpieces exceeding the length of the bending die, it is possible to connect a number of bending dies according to the invention directly adjacent and in particular variants of embodiment of bending dies with decoupling and transferring radiation beam portions are suitable, because in this case only one radiation source is required.

In case of such a die arrangement, adjacent bending dies can be axially clamped against each other by means of at least one axially effective clamping element, with the result that the stability of such a die arrangement is increased and furthermore a beam emission in the region of the front walls is reduced.

A bending die according to the invention or a die arrangement according to the invention made of several bending dies preferably comprises an interface for mechanical connecting and optical coupling with a radiation source to be able to insert a concentrated radiation beam emitted by the latter through the beam entry opening into the bending die.

The method according to the invention or a die arrangement according to the invention can advantageously be used for bending workpieces made of a material chosen from a group comprising magnesium, titanium, aluminum, steel, alloys of these metals, spring steel, glass, plastics.

BRIEF DESCRIPTION OF THE DRAWINGS

For a better understanding the invention will be described in more detail by means of the following figures.

In a highly schematically simplified way.

DETAILED DESCRIPTION OF THE PREFERRED EMBODIMENTS

Figure 2:
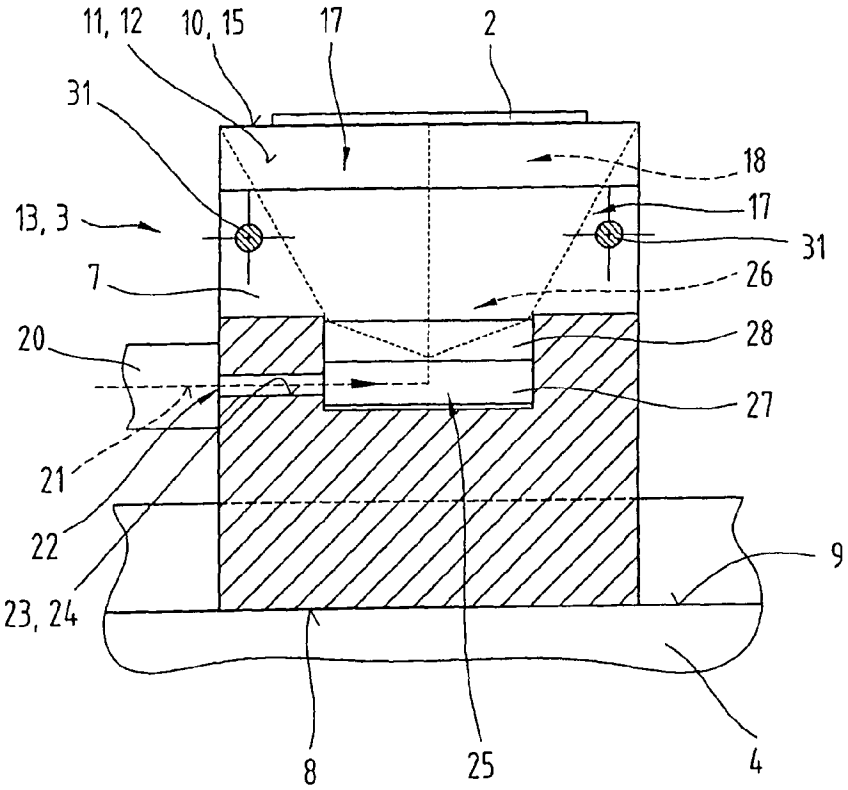
FIG. 2 a cut through a bending die along the line II-II in FIG. 1 with schematically shown guiding and distribution of high-energy radiation within the bending die.

First of all, it should be pointed out that in the variously described exemplary embodiments the same parts are given the same reference numerals and the same component names, whereby the disclosures contained throughout the entire description can be applied to the same parts with the same reference numerals and the same component names. Also details relating to position used in the description, such as e.g. top, bottom, side etc. relate to the currently described and represented figure and in case of a change in position should be adjusted to the new position. Furthermore, also individual features or combinations of features from the various exemplary embodiments shown and described may be construed as independent inventive solutions or solutions proposed by the invention in their own right.

All details relating to ranges of values in this description are to be understood in a way that any and all partial ranges therein are also included, for example the specification 1 to 10 is to be understood in a way that all partial ranges starting at the lower threshold 1 and the upper threshold 10 are included within, that means that any partial ranges start at a lower threshold of 1 or larger and end at an upper threshold of 10 or less, for example 1 to 1.7 or 3.2 to 8.1 or 5.5 to 10.

Figure 1:
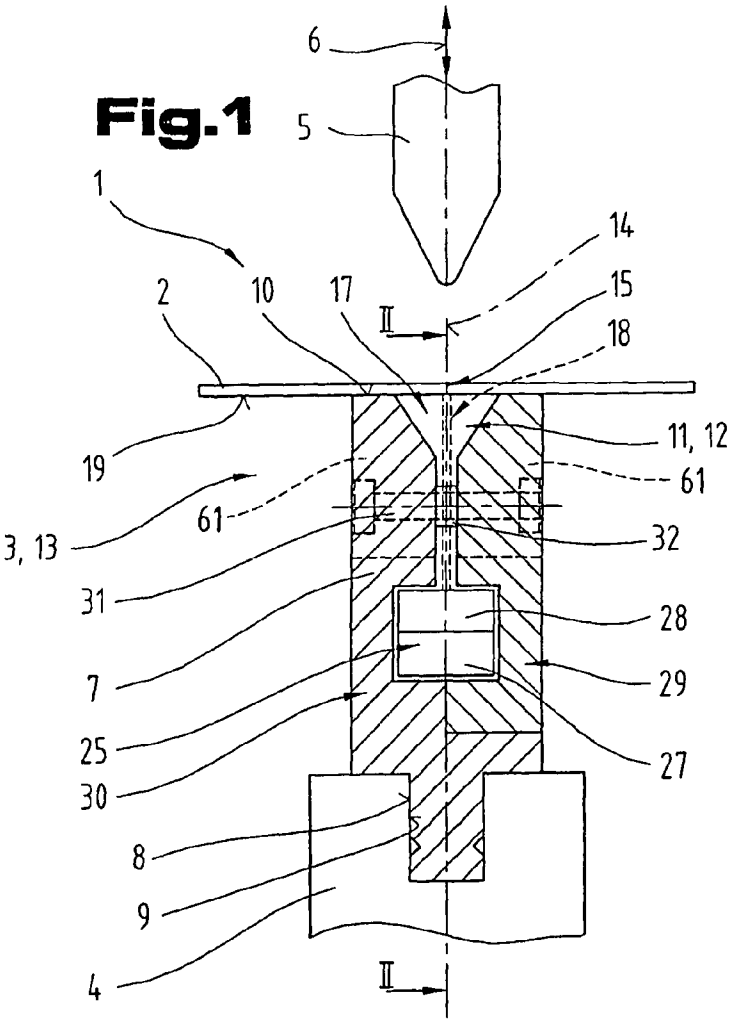
FIG. 1 a cross-sectional view through die arrangement for deforming a workpiece by means of the method according to the invention comprising a bending die and a bending punch.

In FIGS. 1 and 2, a bending tool arrangement 1 applicable for the bending of a workpiece 2 by the method according to the invention is shown. The bending tool arrangement 1 according to the bending die 3 that is arranged at an in part adumbrated, fixed first press beam 4 or pressing table of a bending press or a trimming press and an only in part adumbrated bending punch 5 that is adjustably mounted at a not adjustable second press beam not shown and together with the latter, the bending tool arrangement 1 is in direction of adjustment 6 mounted adjustably for performing a bending deformation. The bending die 3 comprises a tool base body 7 that essentially corresponds to a conventional bending die regarding its outer dimensions. Thus, the bending die 3 preferably has a connection profile 8 that can be used for allocating in a standard tool holder 9 of a press beam 4.

For bending a workpiece 2, the latter is born against a contact surface 10 of the bending die 3 and pressed into a bending recess 11 within the contact surface 10 by means of the bending punch 5, with the result that the workpiece 2 gets a permanent deformation when stresses exceeding a stress limit or a proportional limit of the material of the workpiece appear. In the exemplary embodiment shown, the bending recess 11 is designed as a V-groove 12 and the bending die 3 thus is designed as a V-shaped die 13. The bending punch 5 has a wedge-shaped cross-section, the wedge-angle of which approximately equals the angle of the V-shaped groove 12. The bending recess 11 or the tool base body 7 in general can nevertheless have also any other cross-sectional form that during the bending process allows a supported bearing of the workpiece 2 to be bent at the bending die 3 along two lines between which the bending punch 5 operates. In particular, the bending recess 11 can also have an approximately rectangular cross-section. The bending method performable with such a bending tool arrangement 1 is also called folding and can be performed as air bending or coining.

In the further description the vertical symmetry plane of the bending punch 5 or the bending recess 11 shown in FIG. 1 is referred to as bending plane 14 and their intersection point with the contact surface 10 is referred to as bending line 15, with the bending plane 14 in the exemplary embodiments coinciding with a beam plane, within which the high-energy radiation mainly extends. The bending line 15 thus extends in the middle of a deformation zone within which the plastic deformation of the workpiece 2 is performed during the bending process.

Generically, in case of the method according to the invention, before or during the deformation a high-energy radiation 18 partly marked by a dotted line is, in the area of the deformation zone 16, guided through a beam exit opening 17 to the bottom side 19 of the workpiece 2 bearing against the contact surface 10, with the result that the workpiece 2 is locally heated and thus its mechanical-technological characteristics are changed in a way that the bending deformation can be effected with the necessary quality of the finished workpiece 2. The method according to the invention is preferably applied to brittle raw material, in which a reduction of the elastic limit or a proportional limit, for example of the 0.2% elastic strength, can be achieved by heating the material and the workpiece 2 can thus bear the stresses in low scopes necessary for plastic deformation without exceeding the breaking points.

In the further description of the exemplary embodiments, the high-energy radiation 18 is preferably produced by laser radiation, it is however also possible to alternatively or additionally use another kind of radiation distributing according to the laws of optics for the heating of the workpiece 2.

The high-energy radiation 18 hitting the workpiece 2 is in this ease produced by a radiation source 20 arranged outside of the bending die 3 or arranged distant from the bending die 3 and is inserted through the beam entry opening 22 in the tool base body 7 into the interior of the bending die 3 in the form of at least one concentrated radiation beam 21.

The diameter of a radiation beam 21 of this kind is usually a few millimeters, concerning the method according to the invention one might assume that the diameter of the concentrated radiation beam 21 is smaller than 20 mm.

The radiation beam 21 extend in the interior of the bending die 3 along the beam path 23, which is for example made of a beam channel 24 penetrating the tool base body 7. In the course of the beam path 23, the radiation beam 21 encounters a beam affecting arrangement 25 within the tool base body 7, which deflects, expands and guides the radiation beam 21 through the beam exit opening 17 to the deformation zone of the workpiece 2. In the exemplary embodiment according to FIG. 2, originally horizontally extending radiation beam 21 is deflected approximately vertically upwards by the beam affecting arrangement 25 and expanded to a planer fanned beam 26 that exits through the beam exit opening 17 into the bending recess 11 and hits deformation zone 16 of the workpiece 2 at the bottom side 19. By the beam affecting arrangement 25, the concentrated radiation beam 21 is thus transformed into a planar fanned beam 25 effecting a line-shaped heating zone at the workpiece 2. For this purpose, the beam affecting arrangement 25 comprises a beam deflector 27 and a beam forming element 28 as schematically adumbrated in FIG. 2. In the simplest case, the beam affecting arrangement 25 can be designed of one single optical element that can operate as beam deflector 27 and beam forming element 28 at the same time. As an optical element of this kind, for example a convex mirror could be used, being arranged in the interior of the tool base body 7 and deflecting the concentrated radiation beam 21 into the direction of the workpiece 2 and simultaneously expanding it to a planar fanned beam 26.

In order to achieve a high level of evenness of the beam distribution and to be able to influence the latter easier for a better adjustment to the workpiece 2, it is however of advantage if the beam deflection and beam forming functions are each performed by their respective own optical element. The beam deflector 27 can for example be embodied by a plane mirror, a prism, or any reflecting surface with adequate orientation, whereas the beam forming element 28 can be embodied by a lens, a convex mirror or a concave mirror whereby for the fanning out in a flat planar fanned beam 26, cylindrical optical elements can be used, which are curved in only one direction or are only slightly curved.

FIG. 1 furthermore shows that the tool base body 7 comprises two tool sections 29 and 30 being parallel to and spaced apart from one another, between which the beam affecting arrangement 25 is arranged and the latter is thus protected against mechanical damages and also a housing for the inserted high-energy radiation 18 is designed that can essentially only discharge via the beam exit opening 17. Due to the fact that in a bending process, both tool sections 29 and 30 are heavily stressed apart by the horizontal components of bending power transmitted by the bending dies 3 onto the workpiece 2, it is provided that the both tool sections 29 and 30 are clamped together by means of a clamping element 31 to increase the mechanical stability of the bending die 3, with the distance between the both tool sections 29 and 30 being determined by a spacer 32. To minimize the bending moment affecting the tool sections 29 and 30, the clamping element 31 is positioned between the beam affecting arrangement 25 and the beam exit opening 17, in particular as near to the bending recess 11 as possible.

FIG. 2 shows the arrangement of two clamping elements 31, for example in form of screws of any kind, at the bending die 3, projecting through the two tool sections 29 and 30 in corresponding through borings and clamping the two tool sections 29 and 30 against the spacer 32 arranged between them by means of female screws. Of course, the tool sections 29 and 30 can be also locked in position by alternative screw connections having the same effect, for example by internal screw threads in one of the tool sections. The clamping elements 31 are in this case preferably positioned outside of the planar fanned beam 26, with the result that as little radiation as possible hits the clamping elements 31 or the spacer 32.

Figure 3:
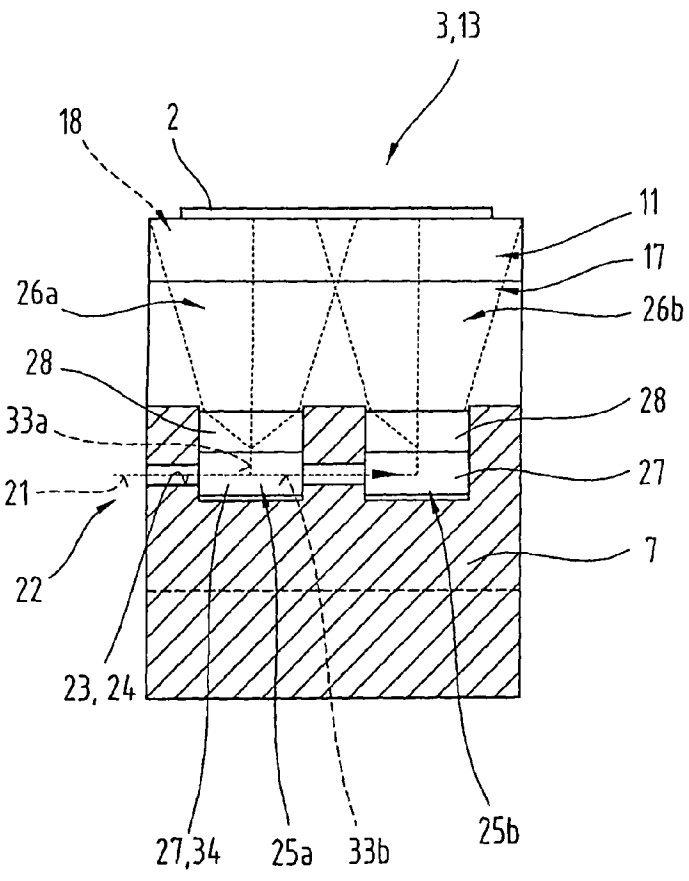
FIG. 3 a cut through further form of embodiment of a bending die with insertion of a concentrated radiation beam and two beam affecting arrangements.

In FIG. 3, another and probably independent embodiment of the bending die 3 is shown, whereby for the same parts the same reference numerals or the same component names like in the previous FIGS. 1 and 2 are used again. In order to avoid redundant repetitions it is referred to the detailed descriptions in FIGS. 1 and 2. The bending die 3 shown in FIG. 3 differs from the bending die 3 described in FIG. 2 in that it contains two beam affecting arrangements **25*a* and 25*b* being arranged one behind another viewed in the direction of the distribution of the radiation beam 21 in the tool base body 7. The concentrated radiation beam 21 inserted through the beam entry opening 22 is split into two radiation beam portions 33***a* and 33*b* by means of the first beam affecting arrangement 25*a*. The first of these radiation beam portions 33*a* is deflected by the beam affecting arrangement 25*a*, deformed to be a first planar fanned beam 26*a* and guided onto the workpiece 2, and the second radiation beam portion 33*b* is transferred to the second beam affecting arrangement 25*b* in extension of the original radiation beam 21 by the beam affecting arrangement 25*a*, is deflected by the beam affecting arrangement 25*b*, is deformed to be a second planar fanned beam 26*b* and guided onto the workpiece 2. For this purpose, the first beam affecting arrangement 25*a* comprises a beam splitter element 34, in this exemplary embodiment forming the beam deflector 27 at the same time. Thus, the beam splitter element 34 can also effect a stepwise or variable adjustable distribution of the radiation beams 21 into radiation beam portions 33*a* and 33*b* of different radiation performances, with the result that the guiding of the beam and the distribution within the bending die 3 are adjustable for different applications.

The beam splitter element 34 is formed of an optical component and splits the inserted radiation beam 21 into the second radiation beam portion 33*b*, which is transferred without change in direction and the first radiation beam portion 33*a*, which is deflected by 90°.

The beam splitter element 34 for example comprises a beam splitter plate, a polarization filter, a beam splitter cube, a Pockels cell, a photoelastic modulator, a Powell lens or optical elements that take advantage of polarization optical, photoelastic or electro-optical effects. The effect of the beam distribution can here be effected by optically active materials like for example at polarization filters or by beam splitter layers, like for example at a beam splitter cube, with which a splitting of intensity of the arriving radiation beam 21 can be achieved. Such intensity beam splitters can separate beams of light comprising a certain wavelength but also polycromatic beams of light into a transmitted and a reflected part, with the possibility of different proportions of division. Beam splitter layers can be formed of metallic layers or dielectric multilayers and dielectric multilayers based on polarization effects are well suitable for the method according to the invention.

Beam splitter plates applicable for the method according to the invention are made of a plane-parallel plate of glass, quartz or a uniaxial crystal with a dielectric or metallic coating. Due to the thickness of the beam splitter plates, the transmitting beam is subject to a slight beam displacement.

Beam splitter cubes are made of two 90°-prisms that are cemented to one another at their hypotenuses, and the beam splitting coating is applied to a hypotenuse and the transmitting beam is not subject to be displaced.

FTIR beam splitter elements work on the basis of the "Frustrated Total Internal Reflection" taking advantage of reflection and absorption effects at beam splitter cubes with an air gap between the two 90°-prisms and this form of a beam splitter is well suitable to effect an adjustable beam distribution by adjusting the air gap, for example by means of piezo actuators that can adjust the prisms of the beam splitter relatively towards each other and thus change the air gap, or by direct embodiment of the prisms of transparent piezoelectric metal, for example LiNbO3 that can be influenced concerning its dimensions by application of a voltage.

The planer fanned beams 26*a* and 26*b* formed of the radiation beam 21 by the two beam affecting arrangements 25*a* and 25*b* are such guided to the bottom side of the workpiece 2 as to overlap each other and the two radiation intensities sum up at the irradiated bending line 15. Because the radiation intensity of a radiation field frequently has a bell-shaped curved distribution, a more even distribution of the radiation along the bending line 15 can be achieved by the overlapping of border zones of adjacent planar fanned beams 26*a* and 26*b*. As already described, the first beam affecting arrangement 25 comprises a beam splitter element 34, a beam deflector 27, whereby the two latter can be formed of one single optical element, as well as a beam forming element 28. In the exemplary embodiment shown, the second beam affecting arrangement 25*b* does not need a beam splitter element 34, because the decoupled second radiation beam portion 33*b* is completely deflected onto the workpiece 2. However, it is also possible that also the second beam affecting arrangement 25*b* comprises a beam splitter element 34 if the latter is such adjustable as to deflect and deform the second radiation beam portion 33*b* completely and without decoupling a further radiation beam portion. The second beam affecting arrangement 25*b* can in this case be formed identically to the first beam affecting arrangement 25*a*, the beam splitter element 34 of which is such adjusted, as to split the power to the two radiation beam portions 33*a* and 33*b* in a proportion 50:50. Should more than two beam affecting arrangements 25*a* and 25*b* be provided in one bending die 3, the beam splitter elements 34*a*, 34*b*, 34*c*, . . . are to be such adjusted as to split the radiation performance of the radiation beam 21 according to the required proportion and several planer fanned beams 26*a*, 26*b*, . . . are guided onto the workpiece 2. An even distribution of performance/power between all radiation beam portions 33 reflecting into the direction of the workpiece 2 is achieved if the reflecting proportion of radiation is 1/n at each beam splitter element, with n being the numbering of the beam splitter elements starting at the last element (1=n) and increasing until the first element.

Figure 4:
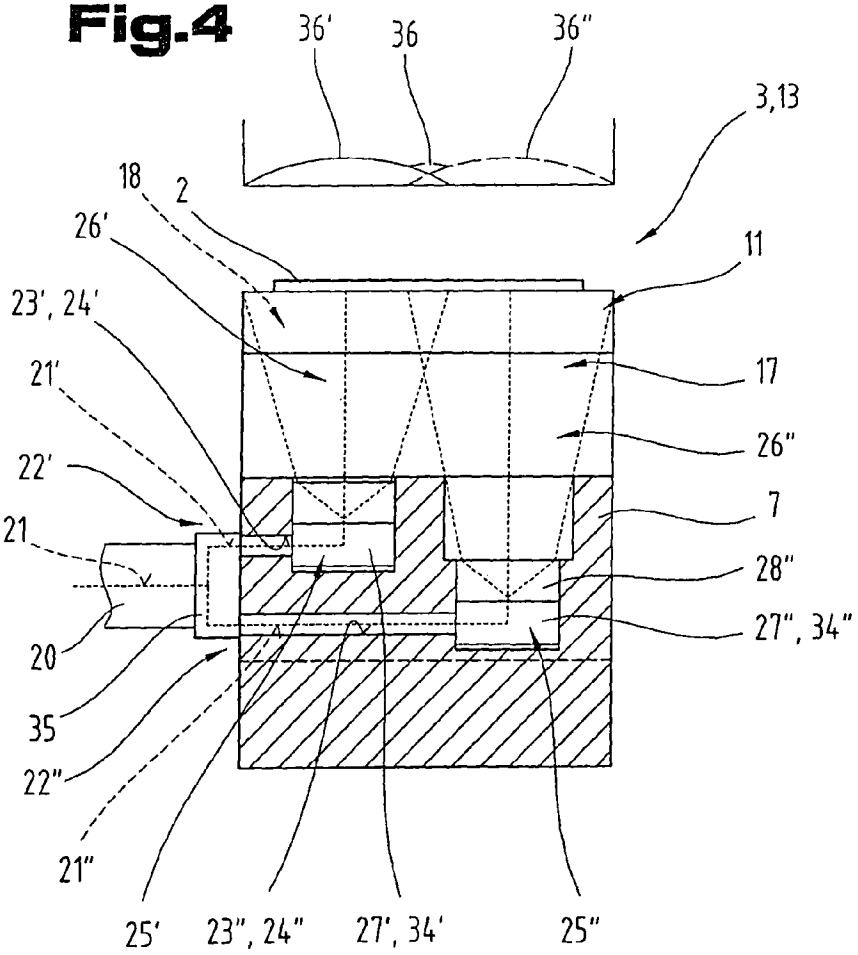
FIG. 4 a cut through further form of embodiment of a bending die with insertion of two concentrated radiation beams and two beam affecting arrangements.

FIG. 4 shows another and probably independent embodiment of the bending die 3, whereby for the same parts the same reference numerals or the same component names like in the previous FIGS. 1, 2 and 3 are used again. In order to avoid redundant repetitions it is referred to the detailed descriptions in FIGS. 1 to 3. At a bending die in FIG. 4, two concentrated radiation beams 21' and 21" are guided into the tool base body 7 and the two radiation beams 21' and 21" are deflected by a beam affecting arrangement 25' or deformed to be a planar fanned beam 26' or 26" that are guided onto the workpiece 2. In the exemplary embodiment shown in FIG. 4, the tool base body 7 has two beam entry openings 22' and 22", to which beam channels 24' and 24" are connected guiding to the beam affecting arrangements 25' and 25" and forming beam paths 23' and 23". It is however alternatively also possible to guide two or more radiation beams 21', 21", . . . through a common beam entry opening 22 and a common beam path 24. In the exemplary embodiment, the inserted radiation beams 21', 21" are produced from one dingle concentrated radiation beam 21 by means of one beam splitter optics 35 arranged outside of the bending die 3. It is however also possible to produce each radiation beam 21', 21" by an own radiation source 20', 20". The beam affecting arrangements 25' and 25" thereby again comprise at least one beam deflector 27' or 27" or a beam forming element 28' or 28" each. The beam deflectors 27', 27" can however also comprise beam splitter elements 34 that are such adjusted as to decouple no radiation beam portion and the radiation beams 21' and 21" are completely deflected onto the workpiece 2. The beam splitter optics 35 can in this case base on the same optical components that are used for the beam distribution with beam splitting arrangements 25 within the bending die 3.

FIG. 4 furthermore shows the overlapping of two radiation intensities 36' and 36" of the two planar fanned beams 26' and 26" in the region of the bending line 15 and one can recognize that a sufficient even resulting total radiation intensity along the bending line 15 is achieved by suitable overlapping of planar fanned beams 26 for the purpose of local heating of the workpiece 2.

Figure 5:
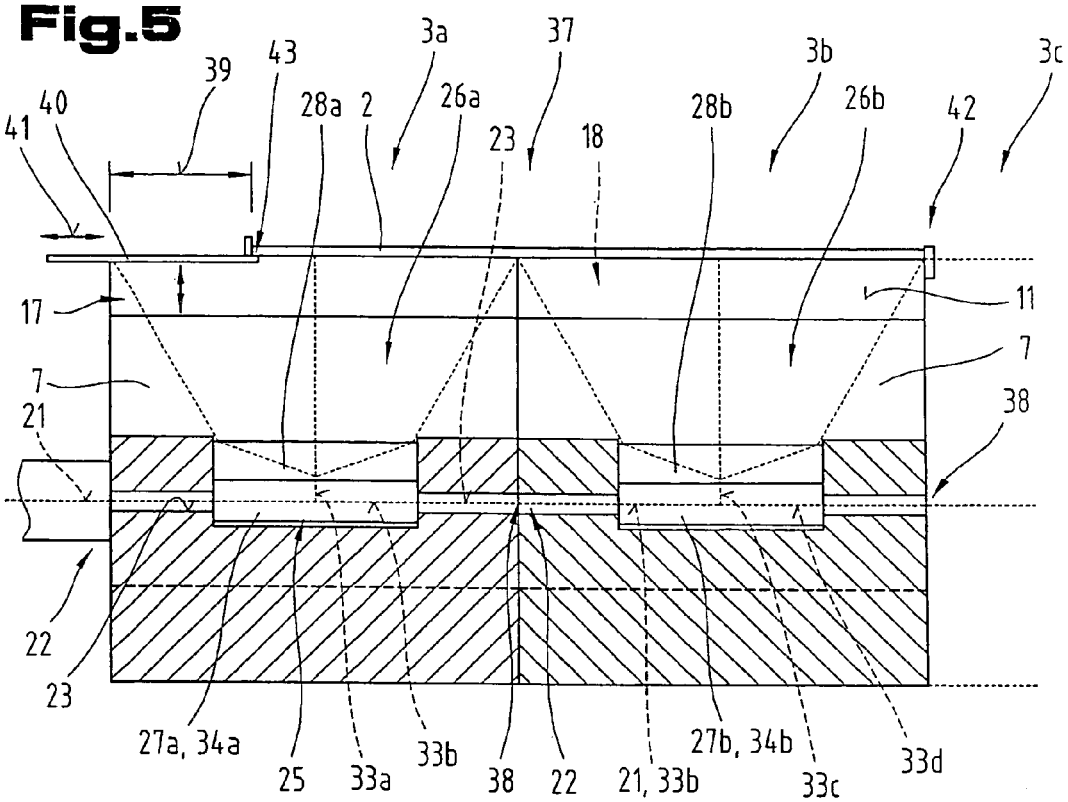
FIG. 5 a cut through a die arrangement comprising at least two bending dies according to embodiment in FIG. 2 with additional means for beam transfer and a shielding device at the bending die.

FIG. 5 shows a die arrangement 37 that is suitable for bending workpieces 2 with a longer dimension in the region of the bending line 15 and that is composed of at least two bending dies 3*a* and 3*b* according to the invention stringed together. At this die arrangement 37, a concentrated radiation beam 21 emitted by a radiation source 20 not shown is inserted through the beam entry opening 22 into the first bending die 3*a* or its tool base body 7, where it is split into a first radiation beam portion 33*a* and a second radiation beam portion 33*b* by means of a first beam affecting arrangement 25*a*. The first radiation beam portion 33*a* is, as already described on the basis of FIGS. 3 and 4, deflected, deformed to planar fanned beams 26*a* and transferred onto the workpiece 2, whereas the second radiation beam portion 33*b* leaves the tool base body 7 via the beam transfer opening 38 and is guided directly through a thereto connecting beam entry opening 22 of the second bending die 3*b* into its tool base body 7 where it is deflected, deformed to be a planar fanned beam 26*b* and guided onto the workpiece above the bending recess 11 of the second bending die 3*b* by means of a second beam affecting arrangement 25*b*. As adumbrated by a dotted line in FIG. 5, the die arrangement 37 can be further extended by another connecting third bending die 3*c*, whereby at this embodiment of a die arrangement 37, the second beam affecting arrangement 25*b* comprises a beam splitter element 34 like the first beam affecting arrangement 25 and said beam splitter elements 34 each decouple a radiation beam portion 33*c* and guide it onto the workpiece 2 and transfer a radiation beam portion 33*d* to the next bending die 3*c* via the beam transfer opening 38. In this case, the maximum length of such a die arrangement 37 is limited by the total performance of the inserted radiation beam 21 and the performance of the radiation beams per bending die 3 necessary for the sufficient heating of the section of the workpiece 2 above.

The beam guidance of a die arrangement 37 corresponds in its effect to the beam guidance in a bending die according to FIG. 3, with the total length of the bending line 15 being achieved by composing several modular-like bending dies 3*a*, 3*b*, . . . , whereas the maximal length of a bending line 15 in the exemplary embodiment according to FIG. 5 is limited by the total length of the bending die 3. This embodiment of a bending die 3 according to the invention for creating a die arrangement 37 has in this case a beam path 23 extending from the beam entry opening 22 to the beam affecting arrangement 25 as well as a beam path 23 extending from the beam affecting arrangement 25 to a beam transfer opening 38, with the beam entry opening 22 and the beam transfer opening 38 being at the same level and thus allowing an easy stringing together of several bending dies 3 of this kind.

FIG. 5 furthermore shows a measure for increasing the job safety in the environment of such a die arrangement 37 that is also deployable in case of applying single bending dies 3 according to the invention. Due to the fact that the bending length of a workpiece 2 to be bent mostly does not match the total length of a bending die 3 or a die arrangement 37, high-energy radiation having a radiation intensity to not to exclude health damages of an operator in the environment of a bending tool arrangement 1 would emit in a section 39 of the bending recess 11 not covered by the workpiece 2. According to the shown embodiment of a die arrangement 37 or a bending die 3, a section 39 of this kind is covered by means of a shielding element 40, with the result that high-energy radiation is prevented from emitting out of the bending die 3. The radiation emitting via the beam exit opening 17 into the bending recess 11 is in this case at least partially absorbed or reflected back into the interior of the bending die 3 by the shielding element 40. The bottom side of the shielding element 40 can in this case additionally have a diverging surface, with the result that the intensity of the reflected radiation continues to decrease and is spread over larger areas of the interior of the die.

For adjusting to various lengths of a workpiece 2, the shielding element 40 can advantageously be adjustable into the direction of the arrow 41 by means of an adjustment device not shown. A shielding element 40 of this kind could also be provided at the right ending of a die arrangement 37 or a single bending die 3 shown in FIG. 5, it is however constructional easier if the workpiece 2 to be bent is always positioned at a fixed stop 42 and thus an approximation of a shielding element 40 is only necessary from one side.

Figure 6:
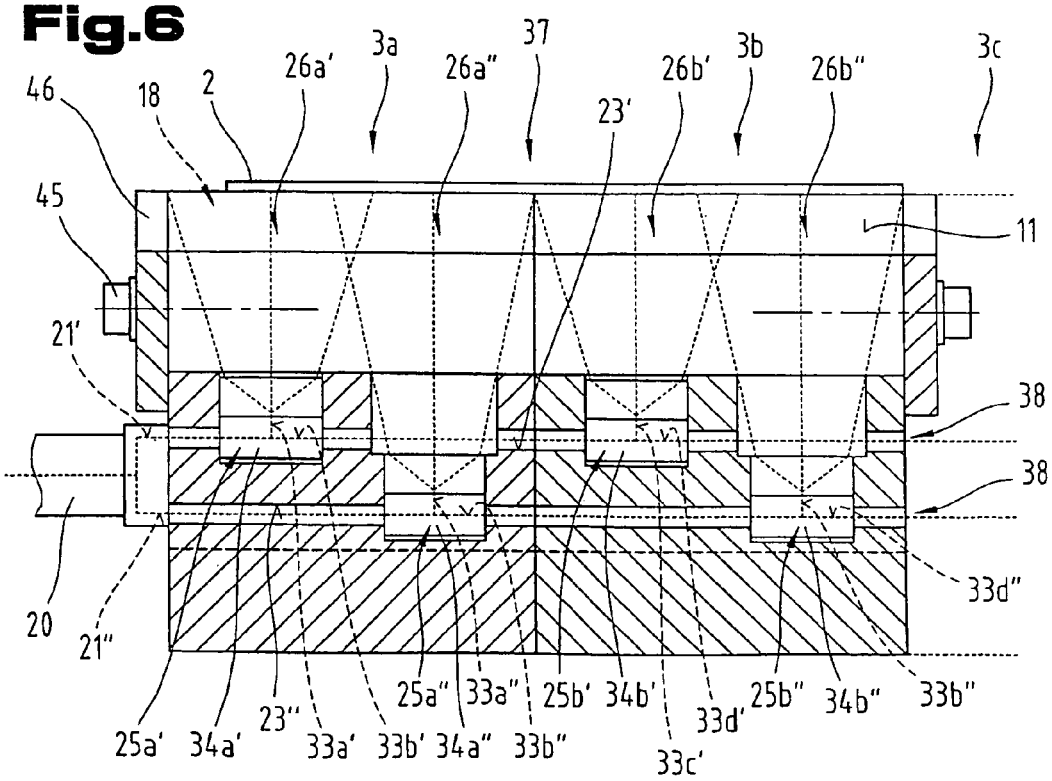
FIG. 6 a cut through a die arrangement comprising at least two bending dies according to the embodiment in FIG. 4 with additional means for beam transfer.

The bearing of the shielding element 40 at the workpiece 2 to be bent can be ensured by the fact that it is approached to the workpiece 2 with a certain minimum power, and additionally a mechanical or optical query concerning the contacting of the workpiece and thus the complete shielding of the section 39 can be ensured. This can for example be effected by the fact that the shielding element 40 has a check mark 43 at its end of the top side facing the workpiece and the check mark 43 is supervised by a camera, not shown, mounted above the die arrangement 37. In case of a relocation of the check mark 43 at the shielding element 40 below the edge of the workpiece 2, the check mark 43 cannot be detected anymore from above, from which is deducible that the shielding element 40 rests against the workpiece 2. In this case, the end section with the check mark 43 has a notch in the area of the bending line 15 to allow that it can also be irradiated by the high-energy radiation at the edge of the workpiece 2. Furthermore, in this form of embodiment, the shielding element 40 is mounted moveable into the direction of the double arrow 44, with the result that the shielding element 40 and the workpiece 2 can together be pressed into the interior of the bending recess 11 when am bending process is performed. For this purpose, the shielding element 40 can for example be mounted springy or swiveling and is located in uplifted position without the influence of the bending punch 5. A bending recess 11 with a rectangular inside cross-section simplifies the movability of the shielding element 40 into the interior of the bending recess 11. FIG. 6 shows a die arrangement 37 for bending a workpiece 2 with two bending dies 3*a* and 3*b* stringed together, with these bending dies 3*a* and 3*b* are similar to a bending die 3 according to embodiment in FIG. 4 but they contain additional beam paths 23 where radiation beam portions 33*b*', 33*b*", 33*d*', 33*d*" decoupled by means of beam splitter elements 34 are guided to beam transfer openings 38 and can thus be guided into a following bending die 3. The single beam affecting arrangements 25*a*', 25", 25*b*', 25*b*" in this case comprise one beam splitter element 34 each, which can simultaneously form the beam deflector 27, as well as a beam forming element 28 that is used for transferring decoupled radiation beam portions 33*a*', 33*a*", 33*c*' and 33*c*" to a workpiece 2 in form of planar fanned beams 26*a*', 26*a*", 26*c*' and 26*c*". All the beam affecting arrangements 25 can in this case be constructional identical, if they are suitable to adjust the part of transmitted radiation power and deflected decoupled radiation power at their beam splitting element 34 to the respective configuration. This adjustment can be effected manually, but it is preferably effected on the basis of automated collection of the tool configuration and/or the workpiece parameters and/or the power of the beam portion and preferably automatically open-loop or closed-loop controlled by means of suitable adjusting units, for example stepper motors or piezo actuators at the beam splitter elements 34.

In FIG. 6, additionally a clamping element 45 is shown, which can be used to axially clamp against each other clamp bending dies 3*a* and 3*b*, . . . stringed together. Additionally, the die arrangement 37 can be provided with end elements 46 at its front side, to avoid a discharge of beams in axial direction. Such end elements 46 can also be axially clamped against the outer bending dies 3 by means of the clamping element 45, with the result that a die arrangement 37 manageable as a unit is formed.

Figure 7:
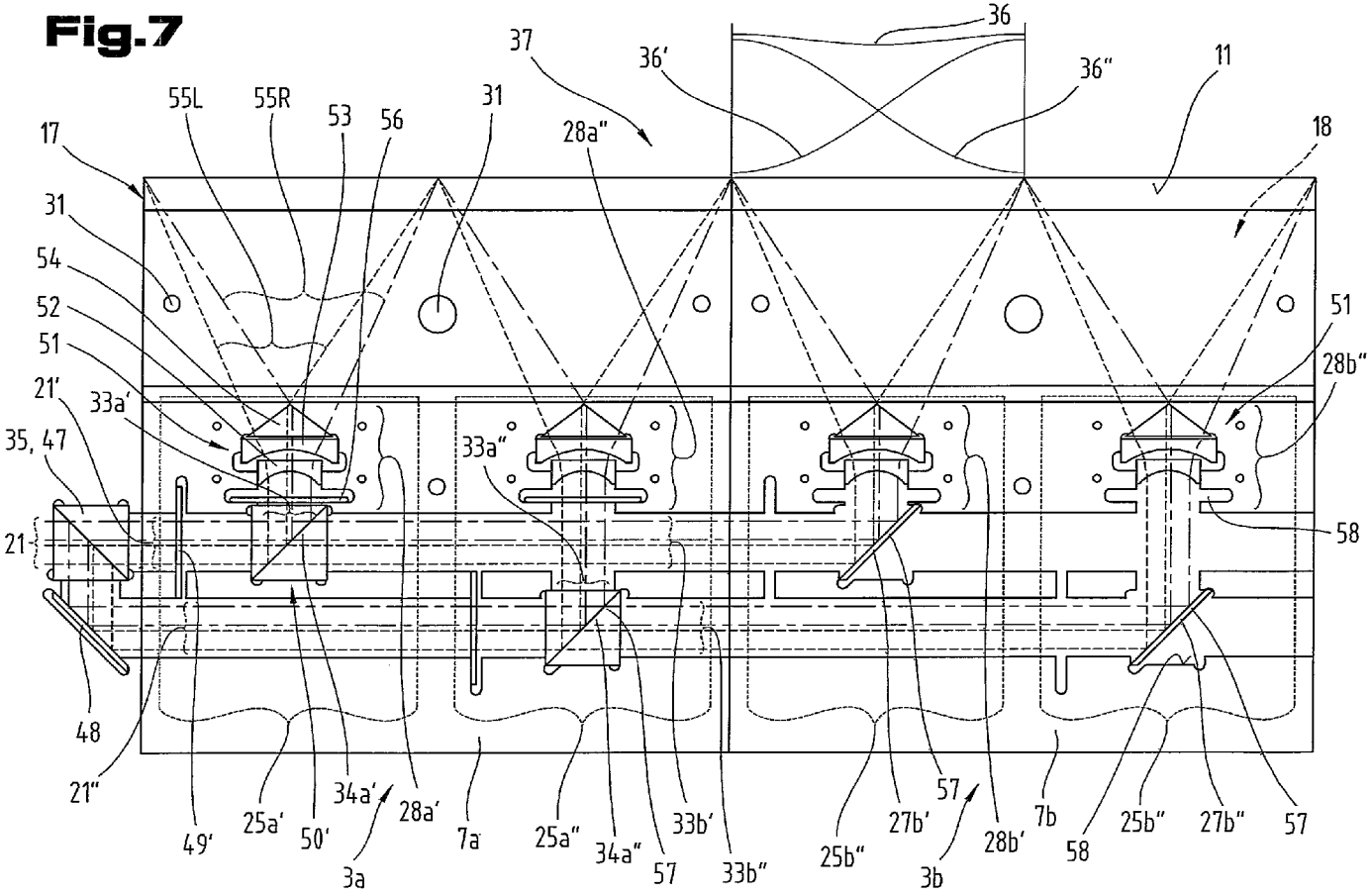
FIG. 7 a cut through a further form of embodiment of a bending die with guiding and distribution of high-energy radiation by two beam affecting arrangements within the bending die.

FIG. 7 shows an embodiment of a die arrangement 37 comprising two bending dies 3*a* and 3*b* that are arranged one after another in the direction of the bending line and directly border one another. In case of this die arrangement 37, by means of a radiation source not shown, e.g. by means of fiber optics, a concentrated radiation beam 21 is guided into the region of the die arrangement 37 where an external fitted beam splitter optics 35 in form of a polarization beam splitter cube 47 with following deflecting mirror 48 splits it into two concentrated radiation beams 21' and 21" that are guided into the first bending die 3*a* via the beam entry openings 22' and 22" at the front side. Before the beam splitting optics 35, the original radiation beam 21 is preferably brought into a most non-polarized state possible by means of a not shown depolarizer, with the result that in case of beam portioning into a vertically linear positioned radiation beam 21' and a horizontally linear positioned radiation beam 21" by means of a polarization beam splitter cube 47, a portioning of the total radiation power is effected in a proportion 50:50 i.e. both radiation beams 21' and 21" are nearly equal. In the course of its beam path 23', the first radiation beam 21' encounters a first beam affecting arrangement 25', which firstly splits the radiation beam 21' into two equal radiation beam portions 33*a*' and 33*b*', deflects the first radiation beam portion 33*a*' and guides it in form of two crossed planar fanned beams lying in one plane, after the beam forming element 28*a*' onto the workpiece 2 through the beam exit opening 17. The beam affecting arrangement 25*a*' in this case comprises, as already described on the basis of previous exemplary embodiments, a beam splitter element 34*a*' and a following beam forming element 28*a*'. Seen into direction of beam distribution, the beam splitter element 34*a*' in this case comprises a half-wave plate 49' and a polarization beam splitter cube (in the following referred to as polarization beam splitter 50 to simplify matters) because also a plate-shaped polarization filter being arranged in the beam path at an angle can be used instead of a polarization beam splitter cube. Due to the fact that the polarization beam splitter 50' allows one direction of polarization to pass unhindered and reflects the direction of polarization perpendicular thereto, a portioning of the radiation intensity of the resulting radiation beam portions 33*a*' and 33*b*' are effected depending on the polarization plane of the existing radiation beam 21. In order to achieve a portioning of 50:50 at the polarization beam splitter 50', the polarization plane of the radiation beam 21' impacting at the polarization beam splitter 50' is adjusted at an angle of 45° by means of the half-wave plate. The twice effected bisecting of the radiation power at the external beam splitter optics 35 and at the first beam affecting arrangement 25*a*' effects that a quarter of the power of the total radiation power of the radiation beam 21 is decoupled at the first beam affecting arrangement 25*a*' and guided onto the workpiece 2. By turning the half-wave plate 49', it is for other configurations of the die arrangement 37 furthermore possible to adjust different levels of decoupling at the polarization beam splitter 50'. The turning of the half-wave plate can in particular be effected by means of a stepper motor that is connected to a control device of the bending press and decouples the respective required portion of the radiation power depending on the bending length of a workpiece by means of open-loop or closed-loop controlled adjustment of the half-wave plate at a beam affecting arrangement.

After being deflected at the polarization beam splitter 50' at the beam forming element 28*a*', the decoupled radiation beam portion 33*a*' is expanded within a beam plane by at least one cylindrical diverging lens or cylindrical lens 51, in this case by two cylindrical plano-concave lenses 52 and 53 following one another and, by means of a prism 54, split into two planar fanned beam portions 55L and 55R within the same beam plane with said planar fanned beam portions 55L and 55R being guided onto the workpiece 2 through the beam exit opening 17 in a crossed manner and thus two irradiation zones overlap.

The radiation beam 21" is split, deflected and deformed by means of the second beam affecting arrangement 25*a*" in an analogous manner as the radiation beam 21'.

The two beam affecting arrangements 25*a*' and 25*a*" furthermore each comprise between the polarization beam splitter 50 and the cylindrical lens 51 one further half-wave plate 56 each, with the help of which the polarization plane of the decoupled radiation beam portions 33*a*' and 33*a*" can be rotated by 90° to effect the transmission through the cylindrical lenses 51 and the following prism 54 with lowest losses possible, to increase the absorption at the workpiece and to realize that the same polarization (parallel to the drawing layer) as in the case of the last two beam portions is existent.

The position of the diagonal sides of the prisms are so chosen as to the central optical path with the highest intensity impacts on the left and on the right of the exterior edges of the two planar fanned beam portions 55L and 55R, with the result that also at the edge regions of the planar fanned beam portions sufficient high radiation intensities are achieved and in the middle region, directly above the prism 54, the two radiation beam portions 55L and 55R overlap each other with their weakened radiation intensities, with the result that the most even possible radiation intensity for the even local heating of the workpiece 2 is achieved.

In the embodiment described, an approximately even power distribution is given exactly at the bottom side 19 of the undeformed workpiece 2, what is not given during the deformation anymore. By a stronger tilting of the planar fanned beams 26, it is under certain circumstances of advantage to place said position, where the distribution of the radiation 18 is the most even, noticeably below the contact surface 10 or the bottom side 19 of the undeformed workpiece 2, in fact to a place where the bottom side 19 of the workpiece 2 is situated at the end of the bending process, because in this phase the highest stresses occur due to the high level of deformation and especially at this time, an even power input is advantageous to avoid crack formation or breakage at the workpiece 2 caused by too low temperatures at the deformation zone 16.

It is under certain circumstances furthermore of procedural advantage, to start the deformation process firstly with a little cold swing, to stop the bending punch 5 to fixate the workpiece 2 and thus to avoid a deformation caused by thermal stresses during the heating by radiation 18 or to minimize it, then to start the heating and then, after a predetermined period of time that can also be zero, or beginning when the deformation zone 16 obtains a certain temperature to continue the bending process, with also the heating is continued until the termination or short before the termination of the swinging. In case, the predetermined period of time is zero, the complete bending deformation is a continuous process during which the energy input by radiation 18 is effected. The energy input can of course also be switched on right from the start. The controlling of the applied thermal energy is then advantageously effected according to the speed of the deformation process.

The passing of the planar fanned beams 26 through the diagonal faces of the prism 54 is preferably effected close to the so-called Brewster's angle, at which the beams polarized in the plane of incidence leave the prism 54 nearly without losses without reflections within the prism 54. The previously described half-wave plates 56 after the beam splitting elements 34 cause that the polarization planes of the decoupled radiation beam portions 33*a*' and 33*a*" are turned into the correct orientation to achieve this effect.

Due to the position of the planar fanned beams 26 within the bending die it is furthermore possible that the tool sections 29 and 30 (see FIG. 1) are clamped against each other, as shown in FIG. 1, by means of clamping elements 31 arranged outside of the planar fanned beams 26 but above the beam affecting arrangements 25, with the result that the mechanical capacitance of such a bending die 3 can substantially be increased or generally achieved. Alternatively, it would also be possible to design a section and particularly the front section of the tool section 29 in a way that it can be clicked or plugged with respect to the remaining tool base body 7, so that a positive locking plugged (from above) connection ensures a mechanical capacity during the bending process, also without using screws. The large advantage would be a simpler and thus shorter possibility to change over to other total die lengths, in case interventions concerning the beam affecting arrangements 25 are required.

In case of a die arrangement 37 according to the invention, several bending dies 3 of this kind with beam splitter elements 34 can be arranged one after another, if the level of decoupling at the single beam splitter elements 34 are such adjusted as to evenly distribute the total radiation power of the inserted radiation beam 21 to all decoupled radiation beam portions 33 deflected onto the workpiece 2.

At each of the last bending die 3 of a die arrangement 37 of this kind, a bending die 3*b* is arranged at which no transfer of one or several radiation beam portions 33 to a further bending die 3 is required and thus a beam splitter element 34 deflecting 100% of the radiation power onto the workpiece 2 or a reflective mirror 56 can be used as a beam deflector 27. The tool base body 7 of the two bending dies 3*a* and 3*b* can be embodied identically, in case suitable recesses 57 allow that the optical components to be used can be exchanged by those providing other characteristics or optionally mounted or omitted. Thus, in the exemplary embodiment shown, instead of each of the polarization beam splitters 50 mirrors 57 are mounted in the right bending die 3*b* and between mirror 57 and cylindrical lens 51 no half-wave plate 56 is mounted and a bending die 3*b* can be reconstructed to be a bending die 3*a* with comparatively low effort. A bending die 3*a* suitable for a beam transfer to an adjacent bending die 3*a* or 3*b*, can be thus referred to as intermediate die, whereas a terminal bending die 3*b* can be referred to as terminal die.

Because the effects that can be achieved with the help of optical elements are multiply subject to the wavelength of the used light, the optical elements used in a bending die 3 according to the invention or a die arrangement 37 according to the invention are advantageously adjusted to the composition of light of the radiation source 20 used. Thus, a radiation source 20 in form of a helium-neon laser has for example a wavelength of 633 nm, whereas a Nd:YAG laser has a wavelength of 1064 nm. A CO2 laser, also coming into consideration as an energy source, has a typical wavelength of 10600 nm.

Figure 8:
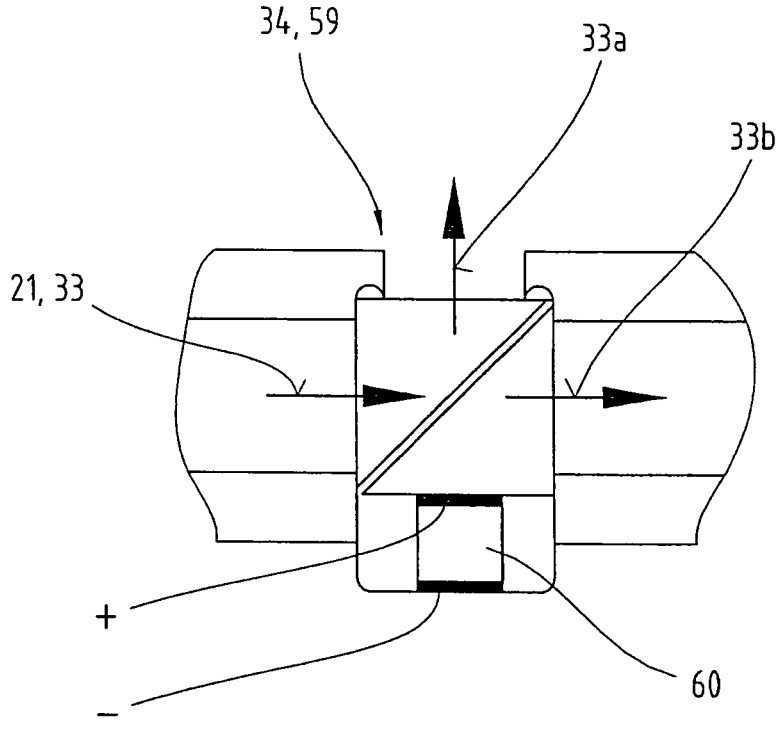
FIG. 8 a possible embodiment of a beam splitter mounted in a bending die.

FIG. 8 shows another possible embodiment of a beam splitter element 34 with variable power distribution between reflected decoupled radiation beam portion 33*a* and transferred radiation beam portion 33*b*, at which the radiation beam 21 or a radiation beam portion 33 is guided into a FTIR-beam splitter 59, the decoupling degree of which can be variably adjusted by means of a piezo actuator. When applying variable voltage to the piezo actuator, an air gap that defines the level of decoupling and that is situated between two prisms forming the FTIR-beam splitter 60 is changed, with the result that the level of decoupling of a beam can be varied in a wide range, preferably between 0% and 100%.

In FIG. 1, another advantageous embodiment of a bending die 3 according to the invention is adumbrated. In this case, the tool base body 7 comprises a die adapter 61 forming the contact surface 10 and the bending recess 11. The die adapter 61 is arranged exchangeable at the remaining section of the tool base body 7 containing the beam affecting arrangement 25. Thus, the tool base body 7 can be adjusted to different bending tasks by exchanging the die adapter 61, particularly the die width can be changed. In this case, the die adapter 61 can be embodied in two parts, with a corresponding part of the adapter being mounted before as well as behind the bending plane 14. However, an embodiment with for example the spacer elements 32 being component part of the die adapter 61 and this thus being embodied to be a mechanical stable unit, is advantageous.

The exemplary embodiments show possible variants of embodiment of the method or the bending die 3 and are not intended to limit the scope of the invention to these illustrated variants of embodiments provided herein but that there are also various combinations among the variants of the embodiments themselves and variations regarding the present invention should be executed by a person skilled in the art. All and every imaginable variants of the embodiment, arising from combining single details of the variant of embodiment illustrated and described are subject to scope of protection.

Finally, as a point of formality, it should be noted that for a better understanding of the structure of the devices according to the invention the latter and their components have not been represented true to scale in part and/or have been enlarged and/or reduced in size.

The problem addressed by the independent solutions according to the invention can be taken from the description.

Mainly the individual embodiments shown in FIGS. 1; 2; 3; 4; 5; 6; 7; 8 can form the subject matter of independent solutions according to the invention. The objectives and solutions according to the invention relating hereto can be taken from detailed descriptions of these figures.

| List of Reference Numerals | |
|---|---|
| 1 | Bending tool arrangement |
| 2 | Workpiece |
| 3 | Bending die |
| 4 | Press beam |
| 5 | Bending punch |
| 6 | Direction of adjustment |
| 7 | Tool base body |
| 8 | Connection profile |
| 9 | Standard tool holder |
| 10 | Contact surface |
| 11 | Bending recess |
| 12 | V-shaped groove |
| 13 | V-shaped die |
| 14 | Bending plane |
| 15 | Bending line |
| 16 | Deformation zone |
| 17 | Beam exit opening |
| 18 | Radiation |
| 19 | Bottom side |
| 20 | Radiation source |
| 21 | Radiation beam |
| 22 | Beam entry opening |
| 23 | Beam path |
| 24 | Beam channel |
| 25 | Beam affecting arrangement |
| 26 | Planar fanned beam |
| 27 | Beam deflector |
| 28 | Beam forming element |
| 29 | Tool section |
| 30 | Tool section |
| 31 | Clamping element |
| 32 | Spacer |
| 33 | Radiation beam portion |
| 34 | Beam splitter element |
| 35 | Beam splitter optics |
| 36 | Radiation intensity |
| 37 | Die arrangement |
| 38 | Beam transfer opening |
| 39 | Section |
| 40 | Shielding element |
| 41 | Arrow |
| 42 | Fixed stop |
| 43 | Check mark |
| 44 | Double arrow |
| 45 | Clamping element |
| 46 | End element |
| 47 | Polarization beam splitter cube |
| 48 | Deflecting mirror |
| 49 | Half-wave plate |
| 50 | Polarization beam splitter |
| 51 | Cylindrical lens |
| 52 | Plano-concave lens |
| 53 | Plano-concave lens |
| 54 | Prism |
| 55 | Planar fanned beam portion |
| 56 | Half-wave plate |
| 57 | Mirror |
| 58 | Recess |
| 59 | FTIR beam splitter |
| 60 | Piezo actuator |
| 61 | Die adaptor |

The invention claimed is:

1. A method for guiding and distributing high-energy radiation, the method comprising steps of:

providing a bending die comprising a tool base body with a contact surface, a groove-like bending recess in the contact surface, a first surface, a first beam entry opening in the first surface, at least one beam exit opening arranged in the groove-like bending recess extending along the groove-like bending recess, and a second surface opposite to the first surface, wherein the tool base body has a subsequent beam path in an interior of the bending die for the high-energy radiation that enters through the first beam entry opening, wherein the subsequent beam path extends in the interior of the tool base body parallel to the longitudinal axis of the groove-like bending recess or a bending line of a workpiece from the first beam entry opening to a beam transfer opening on the second surface of the bending die, wherein said first surface of the bending die and said second surface of the bending die are oriented transversely to the longitudinal axis of the groove-like bending recess, contacting the contact surface of the tool base body via the workpiece to be bent by a bending punch, wherein the at least one beam exit opening in the groove-like bending recess extending along the groove-like bending recess is for discharging high-energy radiation onto the workpiece bearing against the contact surface for heating a deformation zone of the workpiece, introducing at least one high-energy concentrated radiation beam from a radiation source into the tool base body through the first beam entry opening, the radiation source being arranged outside the tool base body, and at least temporally and stationarily deflecting, expanding, and guiding at least a portion of the at least one high-energy concentrated radiation beam onto the workpiece through the beam exit opening to the deformation zone of the workpiece by at least one beam affecting arrangement fixedly arranged within the tool base body in the course of the beam path, wherein the at least one high-energy concentrated radiation beam is expanded into a planar fanned beam that hits the deformation zone of the workpiece parallel to the longitudinal axis of the groove-like bending recess or the bending line of the workpiece, and wherein the planar fanned beam locally heats the workpiece.

2. Method according to claim 1, wherein the at least one high-energy concentrated radiation beam is split into at least two concentrated radiation beam portions via the at least one beam affecting arrangement in the tool base body and at least one of the at least two concentrated radiation beam portions is expanded and guided onto the workpiece through the beam exit opening.

3. Method according to claim 2, wherein polarization beam splitters decouple a concentrated radiation beam portion from the at least one high-energy concentrated radiation beam.

4. Method according to claim 1, wherein via the at least one beam affecting arrangement at least one concentrated radiation beam portion can be decoupled from a concentrated radiation beam or from a concentrated radiation beam portion and transferred to an adjacent bending die through a beam transfer opening in the tool base body.

5. Method according to claim 4, wherein the at least one high-energy concentrated radiation beam is further introduced into a further bending die, comprising a groove-like bending recess, stringed to the bending die, and wherein in the bending die and in the further bending die the same or an adjustable proportion of the radiation power of the radiation source is guided to the respective bending recess of the bending die or the further bending die via the at least one beam affecting arrangement, with the result that an even power distribution is effected.

6. Method according to claim 1, wherein at least two high-energy concentrated radiation beams are introduced into the tool base body and one radiation beam portion is decoupled from each radiation beam and transferred to an adjacent bending die via the at least one beam affecting arrangement.

7. Method according to claim 1, wherein the workpiece is clamped by the bending punch cooperating with the bending die during impact of the high-energy radiation.

8. Method according to claim 1, wherein a Nd:YAG laser device or a $CO_2$ laser device is used as the radiation source.

9. Method according to claim 1, wherein the power emitted by the radiation source or the exposure duration of the radiation onto the material or the geometrical dimensions of the workpiece to be bent are adjusted via an electronic control device.

10. Method according to claim 1, wherein before the application of radiation, the workpiece is subject to a bending deformation and fixed in this position by the bending punch, not until then the heating by discharging radiation onto the bottom side of the workpiece is activated, and on expiry of a predetermined period of time beginning with the activation of the radiation, that can also be zero, or beginning when the workpiece in the deformation zone obtains a certain temperature, the deformation is continued, with the radiation continuing being activated until or shortly before the termination of the bending deformation.

11. The method according to claim 1, wherein the workpiece comprises a material selected from a group consisting of magnesium, titanium, tungsten, aluminum, iron, alloys of said metals, spring steel, glass and plastics.

12. A bending die, comprising:

a tool base body with a contact surface for contacting a workpiece to be bent by a bending punch, a groove-like bending recess in the contact surface, and at least one beam exit opening in the groove-like bending recess extending along the groove-like bending recess for discharging high-energy radiation onto the workpiece bearing against the contact surface for heating a deformation zone of the workpiece, wherein the tool base body has at least a first beam entry opening in a first surface of the bending die with a subsequent beam path in an interior of the bending die for introducing at least one high-energy concentrated radiation beam produced by a radiation source arranged outside the tool base body, wherein said subsequent beam path extends in the interior of the tool base body parallel to the longitudinal axis of the groove-like bending recess or the bending line of the workpiece from the first beam entry opening to a beam transfer opening on a second surface of the bending die opposite to the first surface, wherein said first surface of the bending die and said second surface of the bending die are oriented transversely to the longitudinal axis of the groove-like bending recess, wherein inside the tool base body in the course of the beam path is fixedly arranged at least one beam affecting arrangement that temporally and stationarily deflects, expands and guides at least a portion of the at least one high-energy concentrated radiation beam through the at least one beam exit opening to the deformation zone of the workpiece, and wherein the at least one high-energy concentrated radiation beam is expanded into a planar fanned beam that hits the deformation zone of the workpiece parallel to the longitudinal axis of the groove-like bending recess or the bending line of the workpiece.

13. The bending die according to claim 12, wherein in the tool base body, at least two beam paths for two radiation beams or two radiation beam portions are arranged parallel to and spaced apart from one another.

14. The bending die according to claim 12, wherein at least one beam affecting arrangement is arranged in each beam path.

15. The bending die according to claim 12, wherein the at least one beam affecting arrangement comprises a beam deflector for changing the direction of the beam.

16. The bending die according to claim 15, wherein the beam deflector comprises at least one prism, one mirror or one beam splitter element.

17. The bending die according to claim 12, wherein the at least one beam affecting arrangement comprises at least one cylindrical lens for expanding the beam.

18. The bending die according to claim 12, wherein the cylindrical lens has an axis of curvature extending perpendicularly to a beam plane.

19. The bending die according to claim 12, wherein the at least one beam affecting arrangement comprises at least one beam splitter element for producing at least two radiation beam portions.

20. The bending die according to claim 19, wherein the beam splitter element comprises a turnable half-wave plate or a FTIR element with piezo actuator for adjusting the width of a gap, a photoelastic modulator, a Pockels cell, and a Powell lens, with the result that intensities of the produced radiation beam portions are mutually influenceable by the beam splitter element.

21. The bending die according to claim 12, wherein the beam splitter element, viewed in direction of beam distribution, comprises a half-wave plate and a subsequent polarization beam splitter.

22. The bending die according to claim 12, wherein the beam affecting arrangement comprises at least one collimation lens in the beam path of the at least one high-energy concentrated radiation beam or of one of radiation beam portions subsequently arranged after a beam splitter element for compensating a beam widening.

23. The bending die according to claim 12, wherein the at least one beam affecting arrangement comprises a half-wave plate for optional turning of a polarization plane, a polarization beam splitter for decoupling a radiation beam portion, at least one cylindrical lens for beam widening, as well as a prism for beam controlling.

24. The bending die according to claim 12, wherein the transmission at a prism in a beam path of the planar fanned beam is effected with no loss by reflection.

25. The bending die according to claim 12, wherein the at least one beam affecting arrangement comprises a beam splitter element splitting concentrated radiation beams into two or several radiation beam portions and a beam forming element which is arranged between the beam splitter element and the at least one beam exit opening and which distributes at least one radiation beam portion into the region of the deformation zone of the workpiece.

26. The bending die according to claim 12, wherein the tool base body comprises two flat tool sections being parallel to and spaced apart from one another, between which the at least one beam affecting arrangement is positioned.

27. The bending die according to claim 12, wherein between the at least one beam affecting arrangement and the beam exit opening, at least one spacer and at least one clamping element, clamping the tool base body against the spacer, are arranged.

28. The bending die according to claim 12, wherein the tool base body, in an end section of the tool base body facing away from the bending recess, has a connection profile that can be held in a standard tool holder of a bending press.

29. The bending die according to claim 12, wherein the contact surface of the bending die is formed of a material with low coefficient of thermal conductivity.

30. The bending die according to claim 12, wherein the tool base body is at least in sections made up of a metal that has at least one of a lower coefficient of thermal conductivity and a lower coefficient of thermal expansion than steel.

31. The bending die according to claim 12, wherein at least one adjustable shielding element for covering sections of the bending recess not being covered by the workpiece are arranged at the bending die, viewed in the direction of beams, after the beam exit opening.

32. The bending die according to claim 12, wherein the tool base body comprises a die adapter that forms the contact surface and the bending recess and that is exchangeably arranged at a remaining section of the tool base body, containing the at least one beam affecting arrangement.

33. A bending die arrangement comprising at least two bending dies directly adjacent to one another in a longitudinal direction of a bending line, wherein a first bending die of the at least two bending dies comprises:

a first tool base body with a first contact surface for contacting a workpiece to be bent by a bending punch, a first groove-like bending recess in the first contact surface, and at least one first beam exit opening in the first groove-like bending recess extending along the first groove-like bending recess for discharging high-energy radiation onto the workpiece bearing against the first contact surface for heating a deformation zone of the workpiece, wherein the first tool base body has at least a first beam entry opening in a first surface of the first bending die with a subsequent first beam path in an interior of the first bending die for introducing at least one high-energy concentrated radiation beam produced by a radiation source arranged outside the first tool base body, wherein said subsequent first beam path extends in the interior of the first tool base body parallel to the longitudinal axis of the first groove-like bending recess or the bending line of the workpiece from the first beam entry opening to a first beam transfer opening on a second surface of the first bending die opposite to the first surface, wherein said first surface of the first bending die and said second surface of the first bending die are oriented transversely to the longitudinal axis of the groove-like bending recess, wherein inside the first tool base body in the course of the subsequent first beam path is fixedly arranged at least one first beam affecting arrangement that temporally and stationarily deflects, expands and guides at least a portion of the at least one high-energy concentrated radiation beam through the at least one first beam exit opening to the deformation zone of the workpiece, wherein the at least one high-energy concentrated radiation beam is expanded into a planar fanned beam that hits the deformation zone of the workpiece parallel to the longitudinal axis of the first groove-like bending recess or the bending line of the workpiece, wherein a second bending die of the at least two bending dies comprises:

a second tool base body with a second contact surface for contacting the workpiece, a second groove-like bending recess in the second contact surface, and at least one second beam exit opening in the second groove-like bending recess extending along the second groove-like bending recess for discharging high-energy radiation onto the workpiece bearing against the second contact surface for heating the deformation zone of the workpiece, wherein the second tool base body has at least a second beam entry opening in a first surface of the second bending die with a subsequent second beam path in an interior of the second bending die for introducing the at least one high-energy concentrated radiation beam produced by the radiation source arranged outside the second tool base body, wherein said subsequent second beam path extends in the interior of the second tool base body parallel to the longitudinal axis of the second groove-like bending recess or the bending line of the workpiece from the second beam entry opening to a second beam transfer opening on a second surface of the second bending die opposite to the first surface, wherein said first surface of the second bending die and said second surface of the second bending die are oriented transversely to the longitudinal axis of the groove-like bending recess, wherein inside the second tool base body in the course of the second beam path is fixedly arranged at least one second beam affecting arrangement that temporally and stationarily deflects, expands and guides at least a portion of the at least one high-energy concentrated radiation beam through the at least one second beam exit opening to the deformation zone of the workpiece, and wherein the at least one high-energy concentrated radiation beam is expanded into a planar fanned beam that hits the deformation zone of the workpiece parallel to the longitudinal axis of the second groove-like bending recess or the bending line of the workpiece.

34. The die arrangement according to claim 33, wherein the adjacent bending dies are with their front sides axially clamped against each other via a clamping element.

* * * * *